US009316055B2

(12) United States Patent
Lin et al.

(10) Patent No.: US 9,316,055 B2
(45) Date of Patent: Apr. 19, 2016

(54) DRILL BIT WITH A DYNAMIC METAL SEAL

(71) Applicants: Chih Lin, Huntsville, TX (US); Aaron J. Dick, Houston, TX (US); Jon D. Schroder, The Woodlands, TX (US); Anton F. Zahradnik, Sugar Land, TX (US); Alejandro Flores, Spring, TX (US); Robert D. Bradshaw, The Woodlands, TX (US)

(72) Inventors: Chih Lin, Huntsville, TX (US); Aaron J. Dick, Houston, TX (US); Jon D. Schroder, The Woodlands, TX (US); Anton F. Zahradnik, Sugar Land, TX (US); Alejandro Flores, Spring, TX (US); Robert D. Bradshaw, The Woodlands, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 272 days.

(21) Appl. No.: 13/886,911

(22) Filed: May 3, 2013

(65) Prior Publication Data

US 2014/0326514 A1 Nov. 6, 2014

(51) Int. Cl.
*E21B 10/25* (2006.01)
*E21B 10/22* (2006.01)

(52) U.S. Cl.
CPC ..... *E21B 10/25* (2013.01); *E21B 10/22* (2013.01); *E21B 2010/225* (2013.01); *Y10T 29/49826* (2015.01)

(58) Field of Classification Search
CPC .... E21B 10/25; E21B 10/22; E21B 2010/225
See application file for complete search history.

(56) References Cited

U.S. PATENT DOCUMENTS

| | | | | |
|---|---|---|---|---|
| 4,429,854 | A | 2/1984 | Kar et al. | |
| 4,822,057 | A * | 4/1989 | Chia et al. | 277/383 |
| 5,251,914 | A * | 10/1993 | Tatum | 277/363 |
| 7,413,037 | B2 | 8/2008 | Lin et al. | |
| 2012/0247833 | A1 * | 10/2012 | Ekseth et al. | 175/45 |

* cited by examiner

*Primary Examiner* — Jennifer H Gay
*Assistant Examiner* — George Gray
(74) *Attorney, Agent, or Firm* — Cantor Colburn LLP

(57) ABSTRACT

In one aspect, a drill bit is disclosed that in one embodiment may include a bit body, a rotating cutter on the bit body, and a metallic seal between the bit body and the rotating cutter that includes a first seal member, a second seal member having a first end in sealing contact with the first seal member, a second end fixed relative to the first end and a bias member between the first end and the second end that adjusts the load on the first seal member in response to external load applied on the drill bit.

16 Claims, 6 Drawing Sheets

DRILL BIT WITH A DYNAMIC METAL SEAL

BACKGROUND

1. Field of the Disclosure

This disclosure relates generally to drill bits and systems that utilize same for drilling wellbores.

2. Background of the Art

Oil wells (also referred to as "wellbores" or "boreholes") are drilled with a drill string that includes a tubular member having a drilling assembly (also referred to as the "bottom-hole assembly" or "BHA"). The BHA typically includes devices and sensors that provide information relating to a variety of parameters relating to the drilling operations ("drilling parameters"), behavior of the BHA ("BHA parameters") and parameters relating to the formation surrounding the wellbore ("formation parameters"). A drill bit attached to the bottom end of the BHA is rotated by rotating the drill string and/or by a drilling motor (also referred to as a "mud motor") in the BHA to disintegrate the rock formation to drill the wellbore. The drill bit is subjected to great mechanical stresses during drilling of a wellbore. Some drill bits, such as roller cone drill bits and hybrid drill bits, include a bearing seal between a non-rotating member and each rotating cone that contains cutters on the roller cones. During drilling, the load on the cones continuously changes due to, among other things, the change in the rotational speed of the drill bit, the nature of the formation, etc.

A function of a bearing seal in a drill bit is to protect the bearing by inhibiting the ingress of drilling fluid and solid and to seal the grease used to lubricate both the bearing and the seal. There are two main seal types: elastomeric seal and metal face seal; both contain elastomeric components which seal and energize the sealing face. The seal components usually are made of elastomer compound formulated for the drilling environment. In geothermal drilling, the temperature in the well can rise above 300° C. and cause thermal degradation of elastomeric compounds used in the seals, resulting in bearing and thus premature drill bit failure.

The disclosure herein provides a metallic seal that addresses some of the above-noted issues.

SUMMARY

In one aspect, a drill bit is disclosed that in one embodiment may include a bit body, a rotating cutter on the bit body, and a metallic seal between the bit body and the rotating cutter that includes a first seal member, a second seal member having a first end in sealing contact with the first seal member, a second end fixed relative to the first end and a bias member between the first end and the second end that adjusts the load on the first seal member in response to external load applied on the drill bit.

In another aspect, a method of drilling a wellbore is provided that in one embodiment includes: conveying a drill string having a drill bit at an end thereof, wherein the drill bit includes a bit body, a rotating cutter on the bit body, and a metallic seal between the bit body and the rotating cutter that includes a first seal member, a second seal member having a first end in sealing contact with the first seal member, a second end fixed relative to the first end and a bias member between the first end and the second end that adjusts the load on the first seal member in response to external load applied on the drill bit, and drilling the wellbore using the drill bit.

Examples of certain features of the apparatus and method disclosed herein are summarized rather broadly in order that the detailed description thereof that follows may be better understood. There are, of course, additional features of the apparatus and method disclosed hereinafter that will form the subject of the claims appended hereto.

BRIEF DESCRIPTION OF THE DRAWINGS

The disclosure herein is best understood with reference to the accompanying figures, wherein like numerals have generally been assigned to like elements and in which.

DESCRIPTION OF THE EMBODIMENTS

Figure 1:
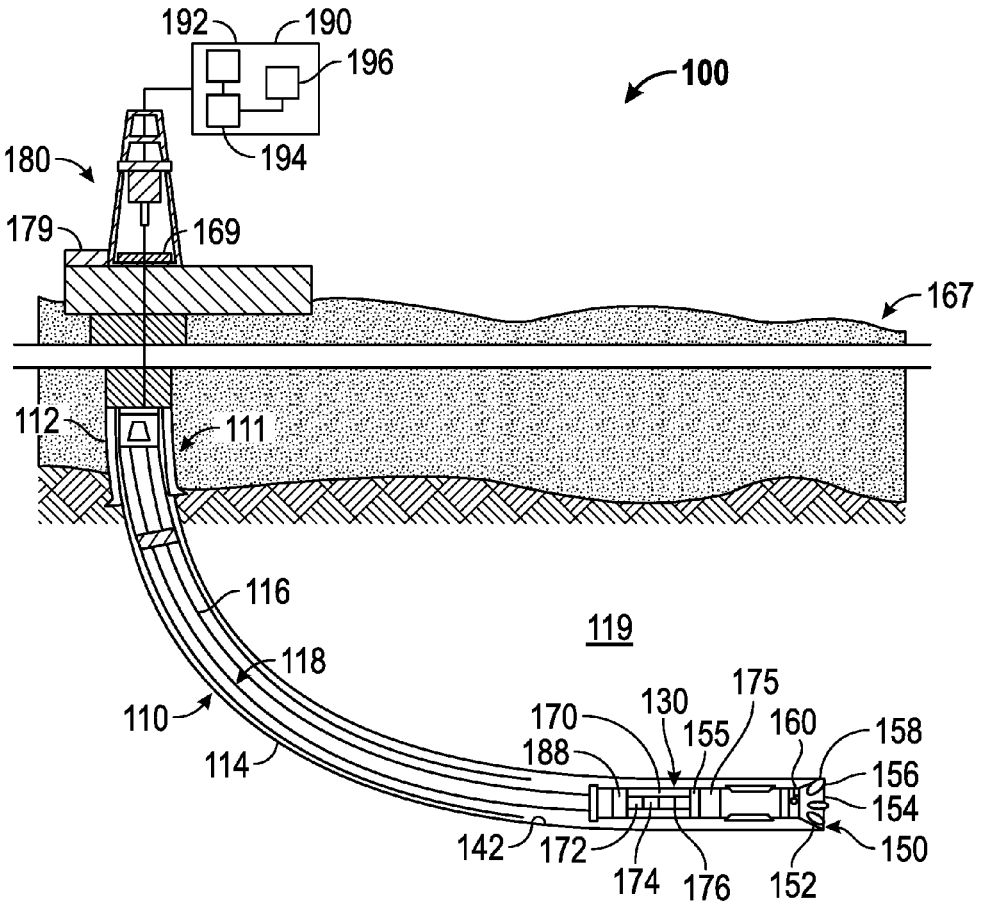
FIG. 1 is a schematic diagram of an exemplary drilling system that includes a drill string that has a drill bit made according to one embodiment of the disclosure.

FIG. 1 is a schematic diagram of an exemplary drilling system 100 that may utilize drill bits made according to the disclosure herein. FIG. 1 shows a wellbore 110 having an upper section 111 with a casing 112 installed therein and a lower section 114 being drilled with a drill string 118. The drill string 118 is shown to include a tubular member 116 with a BHA 130 attached at its bottom end. The tubular member 116 may be made up by joining drill pipe sections or it may be a coiled-tubing. A drill bit 150 is shown attached to the bottom end of the BHA 130 for disintegrating the rock formation 119 to drill the wellbore 110 of a selected diameter.

Drill string 118 is shown conveyed into the wellbore 110 from a rig 180 at the surface 167. The exemplary rig 180 shown is a land rig for ease of explanation. The apparatus and methods disclosed herein may also be utilized with an offshore rig used for drilling wellbores under water. A rotary table 169 or a top drive (not shown) coupled to the drill string 118 may be utilized to rotate the drill string 118 to rotate the BHA 130 and thus the drill bit 150 to drill the wellbore 110. A drilling motor 155 (also referred to as the "mud motor") may be provided in the BHA 130 to rotate the drill bit 150. The drilling motor 155 may be used alone to rotate the drill bit 150 or to superimpose the rotation of the drill bit by the drill string 118. A control unit (or controller) 190, which may be a computer-based unit, may be placed at the surface 167 to receive and process data transmitted by the sensors in the drill bit 150 and the sensors in the BHA 130, and to control selected operations of the various devices and sensors in the BHA 130. The surface controller 190, in one embodiment, may include a processor 192, a data storage device (or a computer-readable medium) 194 for storing data, algorithms and computer programs 196. The data storage device 194 may be any suitable device, including, but not limited to, a read-only memory (ROM), a random-access memory (RAM), a flash memory, a magnetic tape, a hard disk and an optical disk. During drilling, a drilling fluid 179 from a source thereof is pumped under pressure into the tubular member 116. The drilling fluid discharges at the bottom of the drill bit 150 and returns to the surface via the annular space (also referred as the "annulus") between the drill string 118 and the inside wall 142 of the wellbore 110.

The BHA 130 may further include one or more downhole sensors (collectively designated by numeral 175). The sensors 175 may include any number and type of sensors, including, but not limited to, sensors generally known as the measurement-while-drilling (MWD) sensors or the logging-while-drilling (LWD) sensors, and sensors that provide information relating to the behavior of the BHA 130, such as drill bit rotation (revolutions per minute or "RPM"), tool face, pressure, vibration, whirl, bending, and stick-slip. The BHA 130 may further include a control unit (or controller) 170 that controls the operation of one or more devices and sensors in the BHA 130. The controller 170 may include, among other things, circuits to process the signals from sensor 175, a processor 172 (such as a microprocessor) to process the digitized signals, a data storage device 174 (such as a solid-state-memory), and a computer program 176. The processor 172 may process the digitized signals, and control downhole devices and sensors, and communicate data information with the controller 190 via a two-way telemetry unit 188.

Still referring to FIG. 1, the drill bit 150 includes a bit body 152 and a number of rotating cutting members 154, such as rolling cones having a number of cutters 156 thereon, that rotate about pivot points 158 on the bit body 152, when the drill bit 150 is rotated. A seal 160 between the rotating member 154 and the bit body 152 made according to one embodiment of the disclosure provides seal between the rotating member and the bit body, as described in more detail in reference to FIGS. 2-8.

Figure 2:
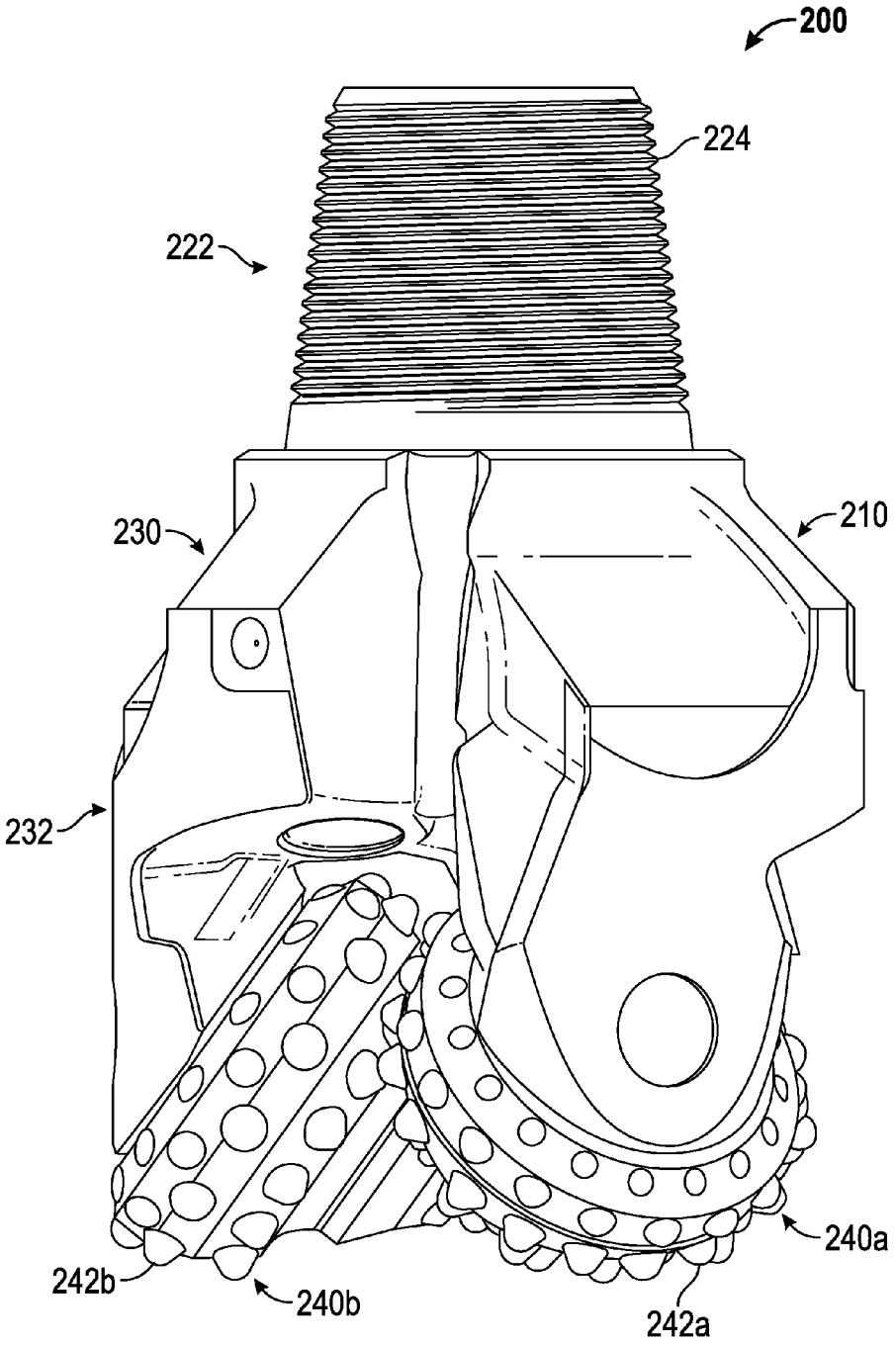
FIG. 2 shows an isometric view of an exemplary tri-cone drill bit made according to an embodiment of the disclosure.

FIG. 2 shows an exemplary drill bit 200 made according to one embodiment of the disclosure. The drill bit 200 shown is a tri-cone drill bit having a bit body 210 that includes a neck or neck section 220 and a shank or shank section 230. The neck has tapered sides 222 that have threads 224 for attaching the drill bit 200 to a box section (not shown) of the drilling assembly (element 130 of FIG. 1). The shank 230 has a longitudinal or axial section 232. Each roller cone 242*a*, 242*b*, etc. is rotatably engaged with the bit body 210 at the bottom of the shank 230 about a head or pivot member. Each cone (242*a*, 242*b*) has cutters 242*a* and 242*b*. When the drill bit rotates, the cones 240*a*, 240*b* rotate, causing the cutters 242*a*, 242*b* to rotate, which disintegrate the formation. Each of the roller cones 240*a*, 240*b*, etc. has a bearing seal between the rotating cone and the shank 210 and thus the bit body 210, according to an embodiment of the disclosure, as described in more detail in reference to FIGS. 3-9.

Figure 3:
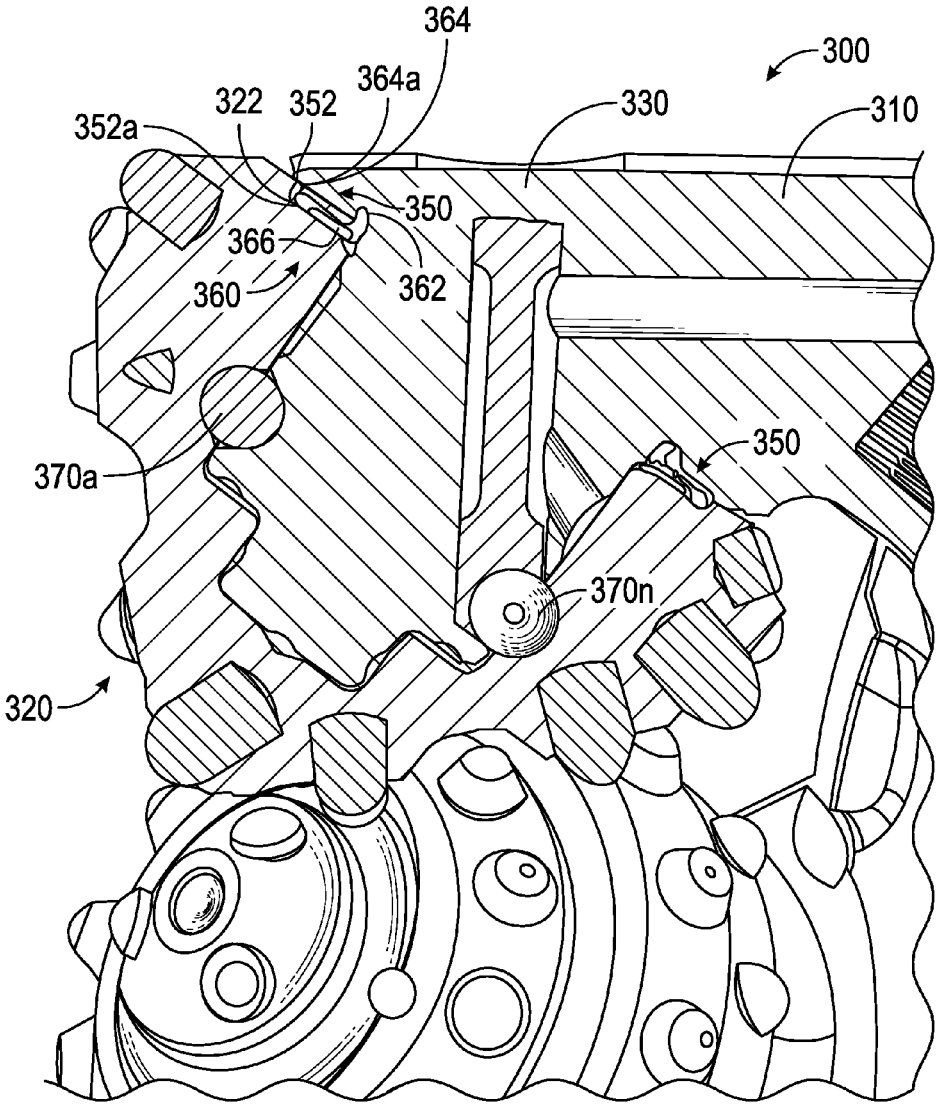
FIG. 3 shows a sectional cross-section view of the drill bit of FIG. 2 that shows a seal between a cone and a drill bit body, according to an embodiment of the disclosure.

FIG. 3 shows a sectional cross-section 300 view of the drill bit of FIG. 2 that shows a seal between a bit body 310 and rotatable cone 320, made according to an embodiment of the disclosure. The cone 320 rotates about a pivot section 330. A seal 350 is provided between the cone 320 and the bit body 330. In one aspect, the seal 350 is a metallic seal that includes a first seal member 352 that is placed in a recess 322 in the cone 320. The seal 350 further includes a second seal member 360 having a first end 362, a second end 364 and a biasing member 366 between the first and second ends. In the particular configuration of FIG. 3, the first end 362 is affixed to the bit body 310 and the second end 364 is in sealing contact with the first seal member 352. The first seal member has a cylindrical or spherical e surface 352*a* that is in sealing contact with a compatible cylindrical or spherical surface 364*a* of the second end 364 of the second seal member 360. In one aspect, the first end 362 of the second seal member may be attached to the bit body 310 by any suitable mechanism, including, but not limited to, press fitting. In the particular configuration of the drill bit of FIG. 3, the first end 362 of the seal member 360 is fixed relative to bit body 310 and thus is a static end. The second end 364 of the seal member 360 is a movable end relative to the first seal member 352 and is thus a dynamic end. In aspects, the seal surface and the seal member are made from a suitable non-elastomeric material. Ball bearings 370*a*-370*n* are placed between the rotating cone 320 and the stationary pivot section 330 to provide a selected load (also referred to herein as the "preload") on the seal 350 and retain the rotating cone 320. The preload causes the surfaces 352*a* and 364*a* to press against each other, thereby providing a seal between the rotating cone 320 and the bit body 310 about the pivot section 330. In operation, when the drill bit 200 rotates, the cone 320 rotates about the pivot section 330. The surface 352*a* rotates against the surface 364*a*. During drilling, the drill string (FIG. 1, element 118) applies load on the drill bit, which is varied during drilling due to changes in rock formation and other drilling factors. As the load on the drill bit varies and the rotating cone 320 moves about the pivot section 330, the bias member 366 adjusts the force or pressure applied on the second end 364 of the seal member 360 and in aspects maintains the load on the seal 350 within a selected range. In one aspect, the bias member 366 may be configured to maintain the load on the seal 350 constant or substantially constant during a certain range of the load on the drill bit.

Figure 4:
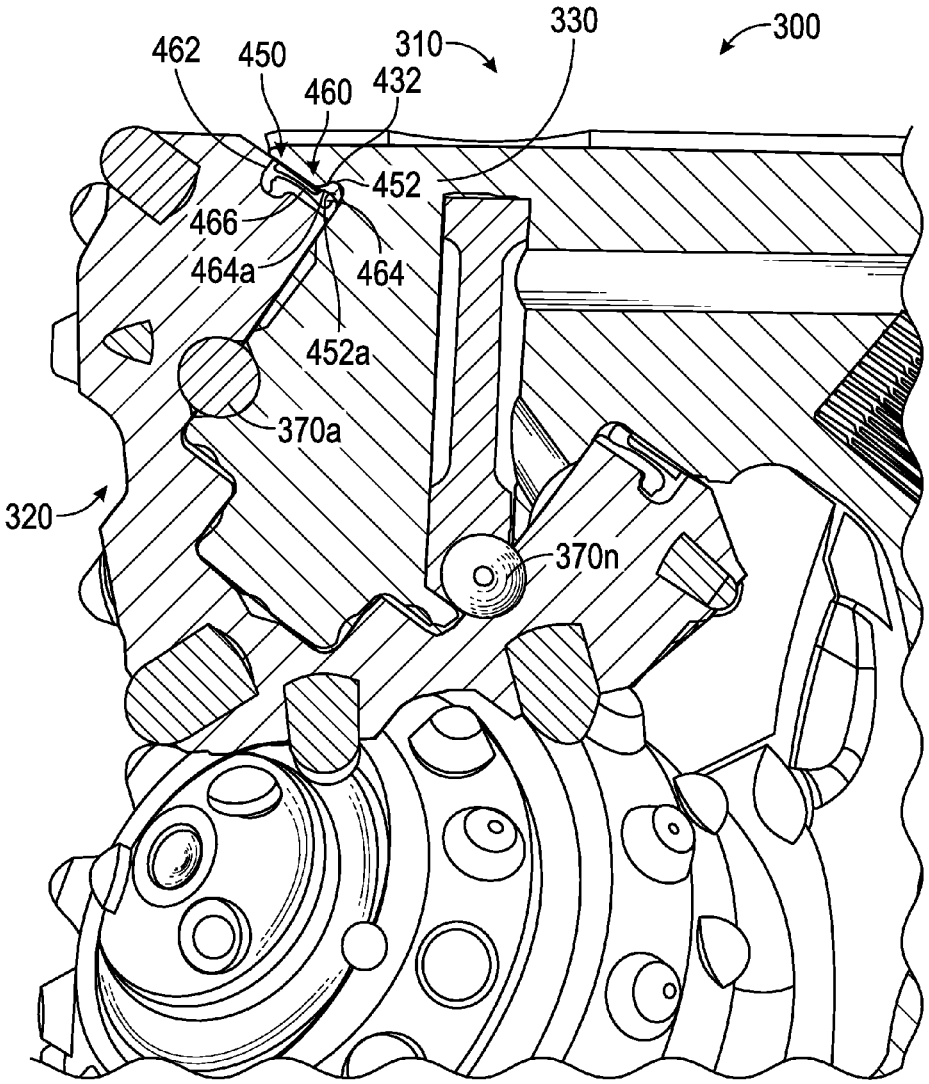
FIG. 4 shows a sectional cross-section view of the drill bit of FIG. 2 that shows a seal between a cone and a drill bit body, according to another embodiment of the disclosure.

FIG. 4 shows a sectional cross-section 400 view of the drill bit of FIG. 2 that shows a seal 450 between the bit body 310 and rotatable cone 320, made according to another embodiment of the disclosure. The cone 320 rotates about a head section (also referred to as the "pivot" or "pivot section") 330. A seal 450 is provided between the cone 320 and the bit body 330. In one aspect, the seal 450 may be a metallic seal that includes a first seal member 452 that is placed in a recess 432 in the head section 330. The seal 450 further includes a second seal member 460 having a first end 462, a second end 464 and a biasing member 466 between the first and second ends. In the particular configuration of FIG. 4, the first end 462 is affixed to the cone 320 and the second end 464 is in sealing contact with the first seal member 452. The first seal member 452 has a cylindrical or spherical surface 452*a* that is in sealing contact with a compatible cylindrical or spherical surface 464*a* of the second end 464 of the second seal member 460. In one aspect, the first end 462 of the second seal member 460 may be attached to the cone 320 by any suitable mechanism, including, but not limited to, press fitting. In the particular configuration of the drill bit of FIG. 4, the first end 462 of the seal member 360 is fixed and thus is a static end. The second end 464 of the seal member 460 is a movable end and is thus a dynamic end. Ball bearings 370*a*-370*n* are placed between the rotating cone 320 and the stationary pivot section 330 to provide a selected load (also referred to herein as the "preload") on the seal 450 and retain the rotating cone 320. The preload causes the surfaces 452*a* and 464*a* to press against each other, thereby providing a seal between the rotating cone 320 and the bit body 310 about the pivot section 330. In operation, when the drill bit 200 rotates, the cone 320 rotates about the pivot section 330. The surface 464*a* rotates against the surface 452*a*. During drilling, the drill string (FIG. 1, element 118) applies load on the drill bit, which varied during drilling due to changes in rock formation and other drilling factors. As the load on the drill bit varies and the rotating cone 320 moves about the pivot section 330, the bias member 466 adjusts the force or pressure applied on the second end 464 of the seal member 460 and, in aspects, may maintain the load on the seal 450 within a selected range. In one aspect, the bias member 466 may be configured to maintain a constant or substantially constant load on the seal 450 during a certain range of the load on the drill bit. In the configuration of FIG. 4, the static end of the seal is attached to the rotating member of the drill bit while the dynamic end of the seal rotates against a seal member in the bit body.

Figure 5:
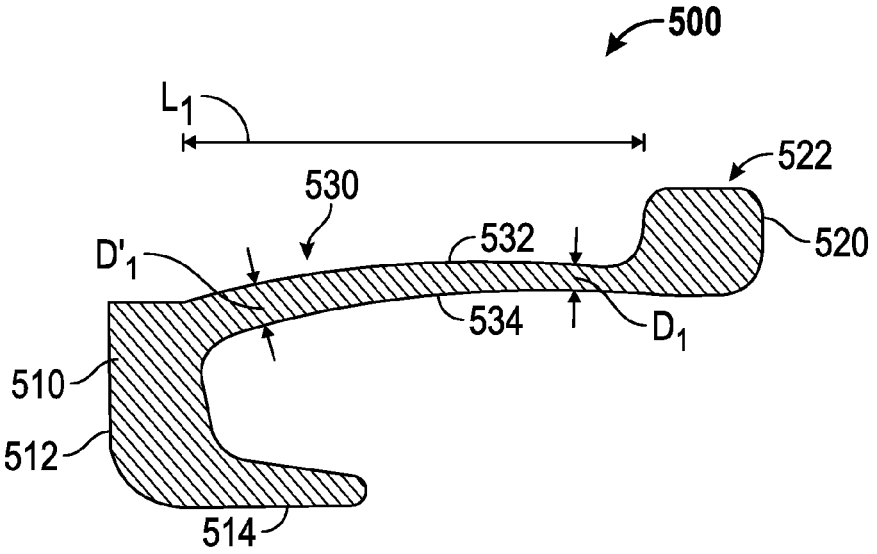
FIG. 5 shows a sectional view of a seal made according to an embodiment of the disclosure.

FIG. 5 shows a sectional view of a seal 500 member made according to another embodiment of the disclosure. The seal member 500 includes a static end 510, a dynamic end 520 and a bias or biasing member or element 530 between the static end 510 and the dynamic end 520. The static end may include a vertical section 512 and a horizontal section 514 for securing the static end to one of the rotating member of the drill bit or to the pivot section or the bit body. The dynamic end 520 includes a seal face 522 configured to be in sealing contact with a seal surface in the rotating member or the bit body as the case may be. The biasing member 530 is a longitudinal member of a selected length L1 and a selected thickness. In one aspect, the biasing member 530 has a width D1 for a section of the biasing member and a thickness of D1' for another section. In one aspect, the bias member 530 has a first side 532 and a second side 534. At least one of the sides 532 or 534 or both may be arced. The thickness of the biasing member 530 may vary along the length L1 of the biasing member 530. The geometry of the biasing member defines the load generated on the dynamic end 520 when the static end 510 is subjected to a force, such as created by the weight on the drill bit. The biasing member 530 flexes between the static end 510 and the dynamic end 520 when subjected to an external load. The dimensions of the seal member 500 may be chosen to maintain the load on the seal within a selected range about the preload or substantially constant.

Figure 6:
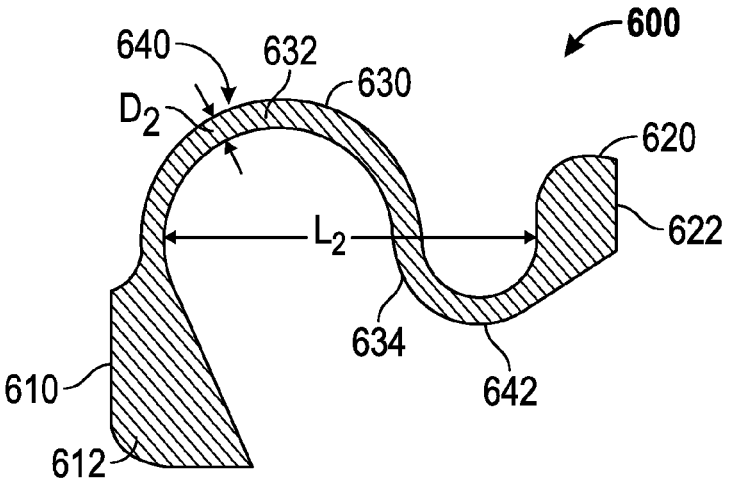
FIG. 6 shows a sectional view of a seal made according to another embodiment of the disclosure.

FIG. 6 shows a sectional view of a seal 600 member made according to another embodiment of the disclosure. The seal member 600 includes a static end 610, a dynamic end 620 and a bias or biasing member or element 630 between the static end 610 and the dynamic end 620. The static end 610 includes an anchoring member 612 for securing the static end 610 to one of the rotating member of the drill bit or to the pivot section or the bit body. The dynamic end 620 includes a seal face 622 configured to be in sealing contact with a seal surface in the rotating member or the bit body as the case may be. The biasing member 630 has a selected length L2 and a selected thickness. In one aspect, the biasing member 630 has a first side 632 and a second side 634. In the particular embodiment of FIG. 6, the biasing member has constant or substantially constant width D2 but may have different widths along its length. In one aspect, the biasing member 630 includes two arcs 640 and 642 that flex when a load is applied onto the biasing member to apply a selected pressure onto the seal surface 622. The geometry of the biasing member 630 may be configured to define the load generated on the dynamic end 620 when the static end 610 is subjected to a force, such as a force created by the weight on the drill bit. The geometry and the dimensions of the seal member 600 may be chosen to maintain the load on the seal within a selected range about the preload or substantially constant.

Figure 7:
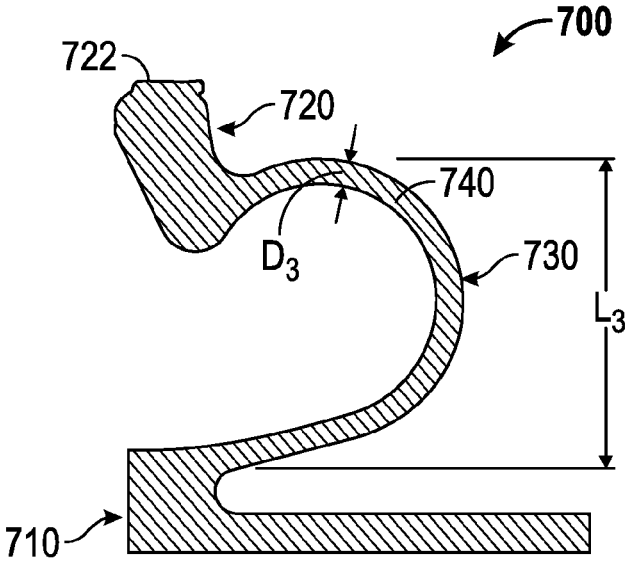
FIG. 7 shows a sectional view of a seal made according to yet another embodiment of the disclosure.

FIG. 7 shows a sectional view of a seal member 700 made according to yet another embodiment of the disclosure. The seal member 700 includes a static end 710, a dynamic end 720 and a bias or biasing member or element 730 between the static end 710 and the dynamic end 720. The static end 710 includes vertical section and a horizontal section 714 for anchoring the seal element 700 to a rotating member of the drill bit or to the bit body. The dynamic end includes a seal face or surface 722 that is placed in sealing contact with a seal surface in the rotating member or the bit body as the case may be. In the particular configuration of FIG. 7, the biasing member 730 has a length L3 and width D3 and includes a single arc 740 that substantially extends from the static end 710 to the dynamic end 720. The width D3 may be constant or may vary along the length D3. The biasing member 730 flexes about the arc 740 when load is applied to the static end to apply a load on the dynamic end. The load applied to the dynamic end may maintain a selected load on the seal, which in one aspect, may be a constant load.

Figure 8:
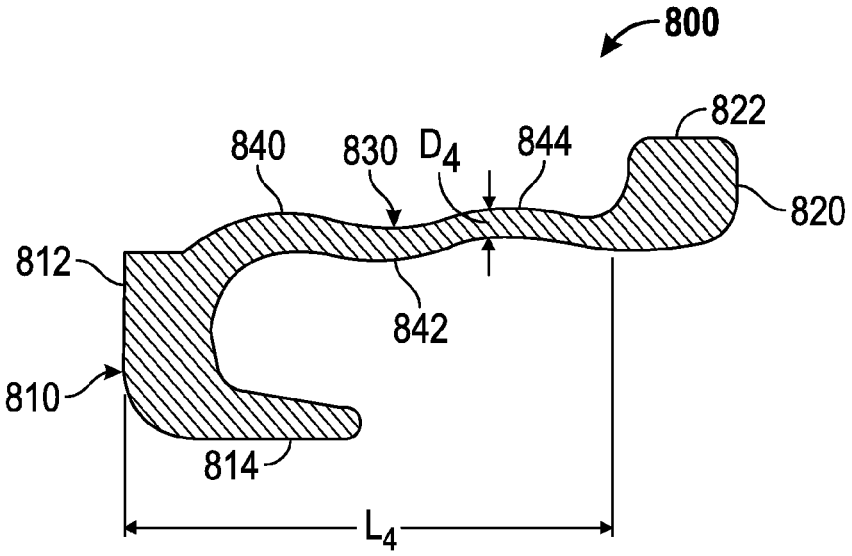
FIG. 8 shows a sectional view of a seal made according to yet another embodiment of the disclosure.

FIG. 8 shows a sectional view of a seal member 800 made according to yet another embodiment of the disclosure. The seal member 800 includes a static end 810, a dynamic end 820 and a bias or biasing member or element 830 between the static end 810 and the dynamic end 820. The static end 810 includes vertical section 812 and a horizontal section 814 for anchoring the seal element 800 to a rotating member of the drill bit or to the bit body. The dynamic end 820 includes a seal face or surface 822 that is in sealing contact with a seal member in the rotating member or the bit body as the case may be. In the particular configuration of FIG. 8, the biasing member 830 has a length L4 and width D4 that may be constant or vary along the length L4. In one aspect, the biasing member may include a number of arced sections, such as sections 840, 842 and 844. The biasing member 830 flexes about the arcs 840, 842 and 844 when load is applied to the static end 810 to apply a load on the dynamic end 820. The load applied to the dynamic end 820 may maintain a selected load on the seal, which in one aspect, may be a constant load.

Although, the seals have been described in reference to rotary cone drill bits, the seals described herein may be utilized in any drill bit having a member that rotates relative to another. In addition, the seal members made according to various aspects described herein may include a geometry wherein both ends may are dynamic or movable with a biasing member or flexible member therebetween. Such a seal member may be retained in position in the drill in any suitable mechanisms.

Thus, in aspects, drill bits with a metallic seal are disclosed, wherein the seal includes may have compliance similar to the elastomeric seal but is resistant to the thermal effects that typically lead to elastomer failure in seals that utilize elastomeric seal members. In aspects, the compliance property of the seal design is accomplished by geometrical design of a seal member. In aspects, the geometrical design may include: a dynamic end or seal section; a bias section or member, and a static or anchor section or end. In another aspect, the geometrical design may include two dynamic ends or seal sections and a bias section or member. The dynamic section includes a surface to form a dynamic seal with a mating surface. The static end may be placed in a rotating member of the drill bit or in the bit body. The biasing spring section provides the a spring action that provides energizing closing force on the seal that causes the seal to resist opening forces generated by the load (hydrodynamic pressure) and movement of the rotating member, such as the cones. In one embodiment, the anchor section connects the seal member to a seal gland surface and to forms a static end. The seal member may be installed by shrink-fitting onto the base of the head journal (pivot section) of the drill bit. An alternative installation method may be to attach the static end (base) of the seal member to a head boss through any suitable method, including, but not limited to: welding, brazing and adhesive bonding. In one aspect, the seal may exhibit a load-deflection characteristic that has an asymptote to a horizontal line rather than a parabolic shape. This may allow the seal to maintain a nearly constant sealing force (face load) within the operating deflection range of the seal. The seal may alternatively exhibit a load-deflection characteristic within an operating deflection range of the seal that has a constant slope. This allows the seal to maintain a proportional sealing force (face load) with the deflection.

The seal may be manufactured by any suitable method, including, but not limited to, precision machining, casting or stamping. Precision machining can ensure the accuracy of the part dimensions. The geometries of the seal may be formed using three dimensional printing methods, such as selective laser melting or selective laser sintering of powdered metals. Machined seal elements may be composed of non-galling alloys to reduce friction and wear of the sliding surface. Non-galling alloys include spinodally hardened copper alloys. In such a case, the seal face typically will not need further processing after precision machining but the surface may be improved by applying a coating with a suitable abrasive resistance material, such as tungsten carbide, titanium nitride, synthesize diamond, or diamond-like carbon, etc. or a more lubricious material such as commercially know as Teflon (PTFE), molybdenum disulfide (MoS2), etc. The coating can be applied through one of many chemical or physical vapor deposition processes or electro-plating, known in the art.

In addition, the seal geometry of the seal member may be shrunk-fit or alternatively retained and statically sealed to the rotating member, such as the cone, and the dynamic seal is between the seal inner diameter and the base of the head bearing journal. This may reduce the dynamic seal diameter, and thus reduce sliding speed of the seal during operation. This configuration may also facilitate cleaning between the seal and head due to the dynamic interface. The seal may also have a secondary or supplemental energizing element between the underside of the extruded seal surface and the static face. For the seal members shown in FIGS. 4-8, this would exist between the dynamic seal surface and the head to which it is fixed. Alternatively if the seal is fixed to the cone, then the secondary energizing element would be placed between the cone and the dynamic seal inner diameter.

The foregoing disclosure is directed to certain specific embodiments for ease of explanation. Various changes and modifications to such embodiments, however, will be apparent to those skilled in the art. It is intended that all such changes and modifications within the scope and spirit of the appended claims be embraced by the disclosure herein.

The invention claimed is:

1. A drill bit comprising:

a stationary body; a rotating member; a first seal surface; and a non-elastomeric seal member exposed to a lubricant, the non-elastomeric seal member including a first end having a second seal surface that is in contact with the first seal surface, a second end that is fixed and a bias member between the first end and the second end, wherein the non-elastomeric seal member comprises a one-piece member constructed using a single metallic material.

2. The drill bit of claim 1, wherein the first seal surface is placed in the rotating member and the second end of the non-rotating seal member is fixed to the stationary body.

3. The drill bit of claim 1, wherein the non-elastomeric seal member provides a load onto the second seal surface in response to an external load.

4. The drill bit of claim 1, wherein the non-elastomeric seal member is preloaded to provide a selected load onto the second seal surface and wherein the bias member maintains the selected load on the second seal surface within a selected range.

5. The drill bit of claim 1, wherein the bias member is a longitudinal member that has an arc along at least one of its sides.

6. The drill bit of claim 1, wherein the bias member has arcs along two sides of the bias member.

7. The drill bit of claim 1, wherein the rotating member is a cone that rotates about a pivot on the stationary body.

8. The drill bit of claim 1, wherein the first seal surface and the second seal surface include a non-galling alloy.

9. A drill bit comprising:

a bit body;

a rotating cutter on the bit body; and a metallic seal between the bit body and the rotating cutter that includes:

a first seal member;

a second seal member having a first end in sealing contact with the first seal member, a second end and a bias member between the first end and the second end that adjusts a load on the first seal member in response to a load applied on the drill bit wherein the second seal member comprises a one-piece member constructed using a single metallic material.

10. The drill bit of claim 9, wherein the metallic seal is preloaded and the bias member maintains the load on the seal within a selected range.

11. The drill bit of claim 9, wherein the second seal member is press fit in one of the bit body and the rotating cutter.

12. The drill bit of claim 9, wherein the first seal member rotates and the first end of the second seal member is stationary relative to the first seal member.

13. A method of making a drill bit, the method comprising:

providing a drill bit having a bit body and a rotating member; and providing a seal between the bit body and the rotating member, the seal including:

a first seal member; and a second seal member having a first end in sealing contact with the first seal member, a second end fixed relative to the first end and a bias member between the first end and the second end that adjusts a load on the first seal member in response to an external load applied on the drill bit, wherein providing the seal comprises providing the second seal member wherein the second seal member comprises a one-piece member constructed using a single metallic material.

14. The method of claim 13, wherein the bias member includes at least one arc.

15. The method of claim 13, further comprising placing the first seal member in the rotating member, affixing the second end of the second seal member onto the bit body and placing the first end of the second seal member in sealing contact with the first seal member.

16. A drill bit comprising:

a stationary body;

a rotating member; and a seal between the rotating member and the stationary member that includes a non-elastomeric seal member to retain a lubricant in a sealed area, the non-elastomeric seal member including moveable end and a fixed end and a bias member between the movable end and the fixed end, wherein the non-elastomeric seal member comprises a one-piece member constructed using a single metallic material.

* * * * *